US009725797B2

(12) United States Patent
Strock et al.

(10) Patent No.: US 9,725,797 B2
(45) Date of Patent: Aug. 8, 2017

(54) PROCESS FOR FORMING AN IMPROVED DURABILITY THICK CERAMIC COATING

(75) Inventors: Christopher W. Strock, Kennebunk, ME (US); Charles R. Beaudoin, Lyman, ME (US)

(73) Assignee: United Technologies Corporation, Farmington, CT (US)

( * ) Notice: Subject to any disclaimer, the term of this patent is extended or adjusted under 35 U.S.C. 154(b) by 2938 days.

(21) Appl. No.: 12/112,328

(22) Filed: Apr. 30, 2008

(65) Prior Publication Data

US 2012/0177840 A1 Jul. 12, 2012

(51) Int. Cl.

| | |
|---|---|
| ***C23C 4/10*** | (2016.01) |
| ***C23C 4/134*** | (2016.01) |
| ***C23C 4/02*** | (2006.01) |
| ***C23C 4/11*** | (2016.01) |

(52) U.S. Cl.

CPC ..... *C23C 4/10* (2013.01); *C23C 4/02* (2013.01); *C23C 4/11* (2016.01); *C23C 4/134* (2016.01)

(58) Field of Classification Search

CPC ..... C23C 4/02
USPC ..... 427/453
See application file for complete search history.

(56) References Cited

U.S. PATENT DOCUMENTS

| | | | | |
|---|---|---|---|---|
| 3,493,415 | A * | 2/1970 | Spitzig et al. | 427/453 |
| 6,051,279 | A * | 4/2000 | Gualco et al. | 427/447 |
| 6,071,628 | A * | 6/2000 | Seals et al. | 428/610 |
| 2004/0033884 | A1 * | 2/2004 | Wallar | 501/103 |
| 2005/0136249 | A1 * | 6/2005 | Arikawa et al. | 428/332 |
| 2007/0259126 | A1 | 11/2007 | Vassen et al. | |

FOREIGN PATENT DOCUMENTS

| | | | |
|---|---|---|---|
| DE | 2538967 | * | 3/1977 |
| DE | 25 38 967 | * | 10/1977 |
| DE | 102004044597 | B3 | 2/2006 |
| EP | 0816526 | A2 | 1/1998 |
| EP | 0937787 | A1 | 8/1999 |
| EP | 1621647 | A2 | 2/2006 |

OTHER PUBLICATIONS

European Search Report dated Mar. 4, 2010.

* cited by examiner

*Primary Examiner* — Katherine A Bareford
(74) *Attorney, Agent, or Firm* — Bachman & LaPointe, P.C.

(57) ABSTRACT

A process for forming a ceramic coating on a substrate, such as a turbine engine component includes the steps of providing a substrate, creating a plasma which preheats the substrate, and forming a ceramic coating by injecting a powder feedstock into the plasma. The ceramic coating forming step comprises depositing ceramic particles having a mean size in the range of from 100 to 150 microns at constant particle morphology.

13 Claims, 1 Drawing Sheet

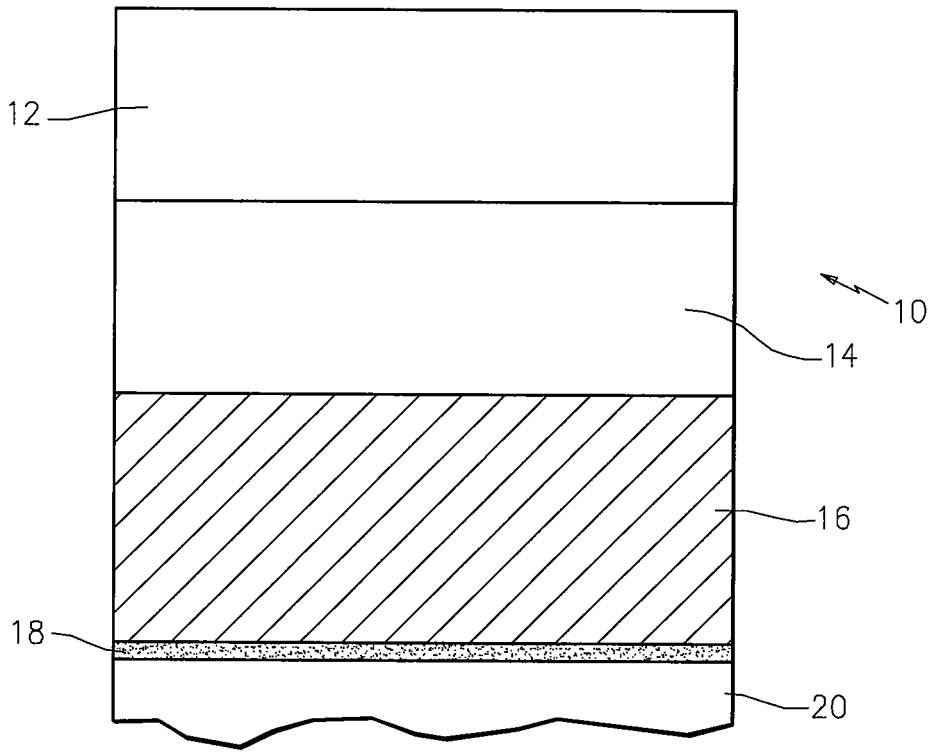
12
10
14
16
18
20

PROCESS FOR FORMING AN IMPROVED DURABILITY THICK CERAMIC COATING

BACKGROUND

A process for forming an improved durability thick ceramic coating on a substrate, such as a turbine engine component, is described.

Thick ceramic abradable seal coatings for high turbine applications have shown deterioration and spallation in applications that run hotter than earlier engine generations. Cracking in thick ceramic coatings is initiated at the hot surface of the coating where sintering begins. Sintering shrinkage causes planar tensile stresses which cause the cracking. Sometimes, the cracking takes the form of mudflat cracks. This type of cracking propagates perpendicular to the stress until a change in anisotropic coating properties and stresses causes crack deflection. Sintering shrinkage as a function of time shows rapid initial densification that is associated with the elimination of the smallest porosity and microstructural defects, i.e. splat boundaries, micro-cracks, and fine porosity.

SUMMARY

By reducing the volume fraction of small defects in the coating by increasing the average size of splats and pores, the sintering rate and amount of shrinkage can be reduced.

In accordance with the present disclosure, a process for forming a ceramic coating on a substrate broadly comprises the steps of providing a substrate, creating a plasma which preheats the substrate, forming a ceramic coating by injecting a powder feedstock into the plasma, and said ceramic coating forming step comprising depositing ceramic particles having a mean size in the range of from 100 to 150 microns at constant particle morphology.

Other details of the process for forming an improved durability thick ceramic coating, as well as other objects and advantages attendant thereto, are set forth in the following detailed description.

BRIEF DESCRIPTION OF THE DRAWINGS

The FIGURE illustrates an improved fully graded coating which can be formed using the process described herein.

DETAILED DESCRIPTION OF THE PREFERRED EMBODIMENT(S)

In accordance with the present disclosure, a process for forming a thick ceramic coating on a substrate, such as a turbine engine component, having improved durability is provided. The coating is formed by the deposition of partially molten or molten droplets of a ceramic coating material using a technique, such as a thermal spray or plasma spray technique, where electricity produces a plasma in a flowing gas that generates a jet of heated and ionized gas into which a powder feedstock is injected, heated, and propelled toward a substrate. When the molten or partially molten particles impinge on the surface of the substrate, they flatten out, solidify, and stick to the surface, forming the coating.

It is desirable that the volume fraction of micron scale defects in the coating be reduced. This may be done as follows. First, the powder feed stock can transfer less porosity to the coating by either being more fully melted during deposition, or by using a powder feedstock that has already been densified by sintering or plasma processing (i.e. plasma fusing or plasma densifying). Second, a higher mass powder feed stock particles may be used to reduce the surface area to volume ratio of the molten droplet and the resultant splat. Higher mass means particles of larger diameter at constant morphology or particles of constant diameter at an increased density. A splat is the solid result of a molten droplet that has impacted a surface and solidified upon contact. Depositing the molten droplets onto a preheated surface: (a) reduces defects by reducing the amount of adsorbed gas that is driven off of the surface during deposition interfering with the bonding between the droplet and coating; (b) increases the amount of fusing between the new splat and the existing coating; and (c) reduces the amount of micro-cracking due to solidification and thermal shrinkage.

A ceramic coating which may be formed on a substrate, such as a turbine engine component, using the process described herein may be 6.0 to 8.0 wt % yttria stabilized zirconia coating. The process described herein is also applicable to any ceramic coating that is subjected to temperatures high enough to cause sintering, such as gadolinia-zirconia, alumina, alumina-titania, mullite, sapphire, and other pure or mixed oxide coatings.

The process for forming the improved durability thick ceramic coatings comprises providing a substrate and preheating a surface of the substrate onto which the coating will be deposited. Preheating may be achieved using the heat of the plasma spray plume or other electric, combustion or radiation heat sources, and be to a temperature of between 500° F. (260° C.) and 2000° F. (1094° C.) for atmospheric plasma spraying. Typical preheat temperature is 800° F. (427° C.) to 1300° F. (705° C.). Plasma spray parameters used to increase the temperature of spray particles typically use a plasma gas mixture that contains nitrogen as the primary plasma gas with at least 10 volume % of hydrogen as the secondary gas. Typically about 25 volume % of hydrogen is used to achieve the required heat transfer rate to the particles. For a plasma torch with a 0.25 inch diameter plasma nozzle, the total gas flow will be in the range of 55 to 125 standard cubic feet per hour (SCFH) (1557.4 to 3539.6 standard liters per hour) with an electric power consumption at the torch of at least 40 kW. Typical parameters are 50 kW, 80 SCFH gas flow rate with a nitrogen to hydrogen ratio of 3 to 1. The coating is formed by injecting a powder feedstock into the plasma so that partially molten or molten droplets of the coating material are deposited onto the substrate surface. Any suitable technique for creating the plasma may be used including, but not limited to, thermal spray techniques and plasma spray techniques.

Larger particles may be deposited by using plasma spray parameters that are tuned to put more heat into the particles. For example, nitrogen may be used as the primary gas instead of argon. Further, more hydrogen secondary gas may be passed, process power may be increased by increasing voltage or amperage, and/or nozzle diameter may be increased to get lower velocity and longer residence time in the plasma.

Larger particles may have a mean size from 100 to 150 microns at constant particle morphology. This helps reduce the splat boundary and intersplat porosity volume fraction by about 50%.

If desired, the powder feedstock which is fed into the plasma may be a predensified powder. A predensified powder is powder that has been previously melted by passing it through a plasma for that purpose or by sintering it at a temperature higher than the anticipated operating temperature for the coating, i.e. a temperature higher than 2500 degrees Fahrenheit (1371° C.). This pre-treatment of the powder increases the theoretical density of the powder feedstock that is fed into the plasma. Current feedstock powders tend to be hollow shells or have a lot of fine porosity. Ideally, the mass of each particle should be increased by 2× to 4×.

The partially molten or molten droplets of the coating material deposited onto the surface of the substrate may take the form of a plurality of splats. A splat is the solid result of a molten droplet that has impacted on the surface and solidified upon contact. There is a fine porosity within the splats which comes from the air space that is present within the particles of the powder feedstock which did not escape during melting and deposition. The porosity can be reduced by modifying the powder feedstock or by more fully melting the powder feedstock during spray. Higher velocity may also reduce the porosity, but may cause thinner splats and higher surface area to volume ratio increasing splat interface contribution to fine porosity. One result of depositing splats with a higher volume to surface area ratio, i.e. larger mass with the same flattening ratio or the same mass splat which is flattened less is that there is less splat boundary volume as indicated as the total splat boundary volume percent in tables I and II.

Intersplat pores are the result of many parameters. They are the trapped air space left under the lifted edges of splats or where small voids are left when the droplets do not fill in all the roughness and contours of the deposition surface. Intersplat pores can be reduced by preheating the deposition surface to lower the quench rate and by increasing the mass, velocity and superheat temperature of the droplets.

Table I shows the particle size distribution for a conventional powder.

TABLE I

| % FINER (%) | DIAMETER (microns) | THEORETICAL SPLAT BOUNDARY VOLUME (%) | SIZE WT FRACTION WEIGHTED V % SPLAT BOUNDARY (%) |
|---|---|---|---|
| 2.5 | 150.5 | 1.203480867 | 0.030087 |
| 12.5 | 106.5 | 1.700705382 | 0.212588 |
| 29.3 | 75.0 | 2.415018579 | 0.706393 |
| 20.5 | 53.0 | 3.417502853 | 0.700588 |
| 15.0 | 37.5 | 4.839194118 | 0.724516 |
| 10.8 | 26.5 | 6.835100459 | 0.734773 |
| 3.3 | 19.0 | 9.533229865 | 0.30983 |
| 2.8 | 13.5 | 13.41723003 | 0.368974 |
| | | total | 3.787749 |

A powder used in the process described herein preferably has a composition as set forth in TABLE II.

TABLE II

| % FINER (%) | DIAMETER (microns) | THEORETICAL SPLAT BOUNDARY VOLUME (%) | SIZE WT FRACTION WEIGHTED V % SPLAT BOUNDARY (%) |
|---|---|---|---|
| 1.0 | 300.0 | 0.603737905 | 0.006037 |
| 2.0 | 250.0 | 0.724488128 | 0.01449 |
| 2.0 | 200.0 | 0.905614202 | 0.018112 |
| 10.0 | 175.0 | 1.034990424 | 0.103499 |
| 30.0 | 150.5 | 1.203480867 | 0.361044 |

TABLE II-continued

| % FINER (%) | DIAMETER (microns) | THEORETICAL SPLAT BOUNDARY VOLUME (%) | SIZE WT FRACTION WEIGHTED V % SPLAT BOUNDARY (%) |
|---|---|---|---|
| 30.0 | 106.5 | 1.700705382 | 0.510212 |
| 20.0 | 75.0 | 2.415018579 | 0.483004 |
| 5.0 | 50.0 | 3.633557245 | 0.181128 |
| | | total | 1.677526 |

Using a powder like that set forth in Table II, the reduction in splat boundary induced sintering shrinkage should be about 56%. The powder may have particles with a mean particle size in the range of from 50 to 300 microns and more than 50% of the powder particles may have a mean particle size of at least 100 microns when injected into the plasma.

If desired, a fugitive pore former may be added to the powder feedstock either by being mixed with the powder feedstock or by being injected simultaneously with the powder feedstock into, for example, the plasma plume of a plasma spray torch. A fugitive pore former is a material that may be deposited with the ceramic material and then removed to leave pore. In practice, it can be a polymer powder that is fed separately into the plasma or mixed with the ceramic powder and fed into the plasma simultaneously to deposit randomly distributed polymer particles that end up in a ceramic matrix of the coating. The polymer is then burned off in an oven or during initial service leaving a pore without harming the adjacent ceramic material.

Methyl methacrylate, polyester, and polyvinyl alcohol (PVA) are likely candidates for the fugitive pore former. Other candidates include any carbon based material that can be burned out, salt that can be dissolved, and any other removable material. Polyester or methyl methacrylate may be used in an amount of about 2.0 to 10 weight % to get a coating porosity of from about 5.0 to 35%.

Larger, low sintering rate pores may be present in the final ceramic coating in the range of 5.0 to 100 microns (0.0005 cm to 0.01 cm). The finer, faster sintering rate pores are generally cracks, gaps, interfaces, spaces between, and various other defects that are formed by the deposition and solidification of the ceramic droplets. They tend to be in the size range of from 1.0 to 5 microns (0.0001 cm to 0.0005 cm inch) and sometimes the size range is less than about 1 micron (0.0001 cm).

Coatings formed using the process herein have a more gradual compositional gradation to reduce stress concentrations. The process modifies the composition of a baseline coating by eliminating a weak layer, such as 20% yttria stabilized layer, where failure can occur and maximizes part temperature during spray with minimized ramp rates to help minimize the coating stresses during service. The FIGURE illustrates a fully graded coating which can be formed using the process of the present invention. The coating 10 includes a layer 12 of porous 7 wt % yttria stabilized zirconia, a layer 14 of porous 7 wt % yttria stabilized zirconia and alumina, and a layer 16 of cobalt-alumina. If desired, the coating 10 may be deposited onto a bond layer 18, such as a MCrAlY layer where M is selected from the group consisting of nickel and cobalt, which has been deposited on the substrate 20. Grading is advantageous in that sharp changes in composition which may be related to stress concentrations are removed by maximizing the grading from one material to the next.

Coatings formed by the process described herein are also different in that they are designed to be at neutral stress conditions, or as close as possible, at operating temperatures and thermal gradients. This may be achieved by maximizing the compositional gradation of the coating and customizing the temperature profile throughout the spray process.

The coatings described herein have improved durability due to both a reduced sintering shrinkage and the reduced stress at component operating conditions provided by the gradual gradation of substrate temperature and composition during coating deposition.

It is apparent that there has been provided a process for forming an improved durability thick ceramic coating. While the process has been described in the context of specific embodiments thereof, other unforeseen variations, alternatives, and modifications may become apparent to those skilled in the art having read the foregoing description. Accordingly, it is intended to embrace those variations, alternatives, and modifications which fall within the broad scope of the appended claims.

What is claimed is:

1. A process for forming a ceramic coating on a substrate comprising the steps of:

providing a substrate;

creating a plasma which preheats said substrate;

forming a ceramic coating by injecting a powder feedstock having particles with a mean particle size in the range of from 50 to 300 microns with more than 50% of the particles having a mean particle size of at least 100 microns into said plasma; and said ceramic coating forming step comprising depositing ceramic particles having a mean size in the range of from 100 to 150 microns at constant particle morphology.

2. The process according to claim 1, wherein said substrate providing step comprises providing a turbine engine component.

3. The process according to claim 1, wherein said depositing step comprises depositing particles in a fully molten state.

4. The process according to claim 1, wherein said depositing step comprises depositing pre-densified particles.

5. The process according to claim 1, wherein said ceramic coating forming step comprises forming a ceramic coating consisting of 6.0 to 8.0 wt % yttria stabilized zirconia.

6. The process according to claim 1, wherein said ceramic coating forming step comprises forming a ceramic coating selected from the group consisting of a gadolinia zirconia coating, an alumina coating, an alumina-titania coating, a mullite coating, and a sapphire coating.

7. The process according to claim 1, further comprising mixing said powder feedstock with a pore former prior to injection.

8. The process according to claim 7, wherein said mixing step comprises mixing said powder feedstock with a polymer powder selected from the group of methyl methacrylate, polyester, and polyvinyl alcohol.

9. The process according to claim 8, wherein said mixing step comprises mixing from about 2.0 to 10 wt % of said polymer powder with said powder feedstock.

10. The process according to claim 7, further comprising removing said pore former to create a coating porosity of from 5.0 to 35% in said coating.

11. The process according to claim 1, further comprising injecting a polymer powder into said plasma and depositing said polymer powder in said coating.

12. The process of claim 11, further comprising removing said polymer powder from said coating to create a coating porosity of 5.0 to 35%.

13. The process according to claim 11, wherein said injecting step comprises injecting a polymer powder selected from the group consisting of methyl methacrylate, polyester, and polyvinyl alcohol.

* * * * *